United States Patent [19]

Volkmar

[11] 4,090,316

[45] May 23, 1978

[54] FIRING PIN SAFETY DEVICE FOR HAND FIREARMS

[75] Inventor: Willi Volkmar, Ulm, Donau, Germany

[73] Assignee: Carl Walther, Sportwaffenfabrik, Ulm, Donau, Germany

[21] Appl. No.: 747,478

[22] Filed: Dec. 6, 1976

[30] Foreign Application Priority Data

Dec. 6, 1975 Germany ..... 2554955

[51] Int. Cl.[2] ..... F41C 17/04

[52] U.S. Cl. ..... 42/70 F; 89/148

[58] Field of Search ..... 42/70 F

[56] References Cited

U.S. PATENT DOCUMENTS

| | | | |
|---|---|---|---|
| 624,321 | 5/1899 | Fyrberg | 42/70 F |
| 3,724,113 | 4/1973 | Ludwig | 42/70 F |
| 3,942,278 | 3/1976 | Schaller et al. | 42/70 F |

*Primary Examiner*—Stephen C. Bentley

*Attorney, Agent, or Firm*—Edmund M. Jaskiewicz

[57] ABSTRACT

A hand firearm has a firing pin which is pivotable between safety and firing positions and a hammer which has a striking surface engaging the firing pin when the firing pin is in its firing position and a recess which receives the firing pin when in its safety position. A first cocking lever is engageable with the hammer to maintain the hammer in its cocked position and there is a release lever pivotable between a first position and a second position in which the release lever engages a firing pin to move the firing pin to its firing position. The first cocking lever is disengaged from the hammer to release the hammer from a cocked position without pivoting of the release lever such that the firing pin remains in its safety position.

9 Claims, 5 Drawing Figures

FIRING PIN SAFETY DEVICE FOR HAND FIREARMS

The present invention relates to a safety device for the firing pin of a hand firearm, more particularly, to the structure of maintaining the firing pin in the safety position when the firearm is loaded.

Hand firearms, particularly of the automatic self-loaded type, have been provided with a firing pin which is pivotable in a plane parallel to the longitudinal axis. The tip of the firing pin is received within a recess machined in the striking surface of the hammer when the firing pin is in the safety position.

Various forms of safety devices have been proposed for such hand firearms. One such safety device comprises a pivotable member which is mounted transversely in the rear portion of the block and engageable with the firing pin. A slide also positioned in the block is lifted by the cocking lever through the release lever in the cocked position of the hammer. In practice, this safety device had the disadvantage that in the event the muzzle of the gun was struck or impacted upon the ground when the hammer is cocked, the safety device occasionally did not function properly. As a result, it was not possible to reliably avoid firing of the weapon since the firing pin was in the lifted position and upon being subjected to forces of impact the firing pin contacted the cap of the cartridge.

In another form of a firing pin safety device the firing pin was fixed with respect with longitudinal axis and was locked against axial displacement by means of a unilateral recess provided in the firing pin. A spring loaded safety device temporarily engaged the recess of the firing pin. This construction had a similar disadvantage in practice since it frequently occurred that this locking of the firing pin was overcome through dropping or striking of the weapon because of the relatively small unilateral locking surface. As a result, there was occasionally accidental firing of the firearm.

It is therefore the principal object of the present invention to provide a novel and improved safety device for the firing pin of a hand firearm.

It is another object of the present invention to provide a safety device for the firing pin of a hand firearm as described above wherein the firing pin remains in its safety position when the hammer is cocked.

It is a further object of the present invention to provide such a safety device which facilitates handling of the firearm when it is rapidly drawn from its case by eliminating projecting safety levers which must be operated from the exterior of the firearm.

It is an additional object of the present invention to provide such a safety device which is simple in construction and reliable in operation so as to avoid accidental firing of the firearm upon dropping or impacting the same.

According to one aspect of the present invention, a safety device for the firing pin of a hand firearm may comprise a firing pin pivotable between a safety position and a firing position. A pivotally mounted hammer has a striking surface engageable with the firing pin in its firing position and there is a recess in the striking surface which receives the end of the firing pin when in its safety position. A first cocking lever has a portion thereon engageable with the hammer when the hammer is in its cocked position to maintain the hammer in this cocked position. A pivotable release lever has a first position and a second position in which it is engageable with the firing pin to pivot the firing pin to its firing position. The second cocking lever has a portion thereon engageable with the release lever. The first cocking lever is disengageable from the hammer to release the hammer from its cocked position without pivoting of the release lever to its second position so that the firing pin remains in its safety position.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
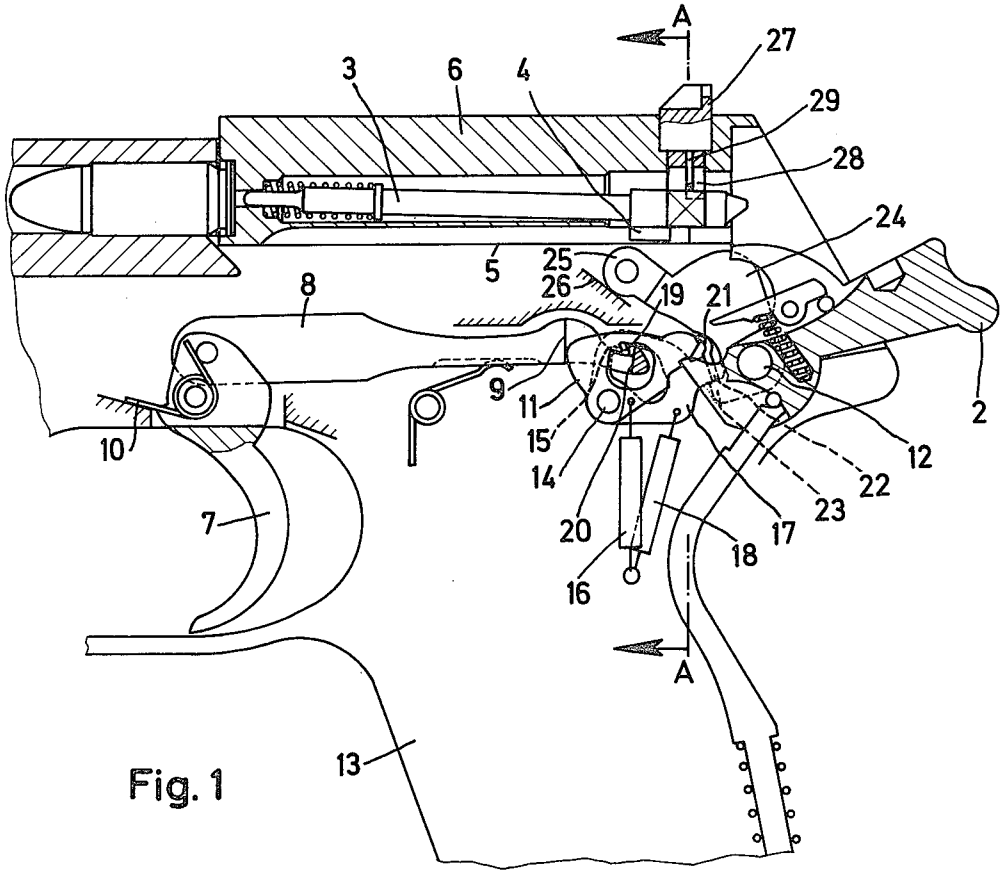
FIG. 1 is an elevational view partially in longitudinal section of a firearm incorporating the present invention showing the hammer in its cocked position and the firing pin in its safety position.
Figure 2:
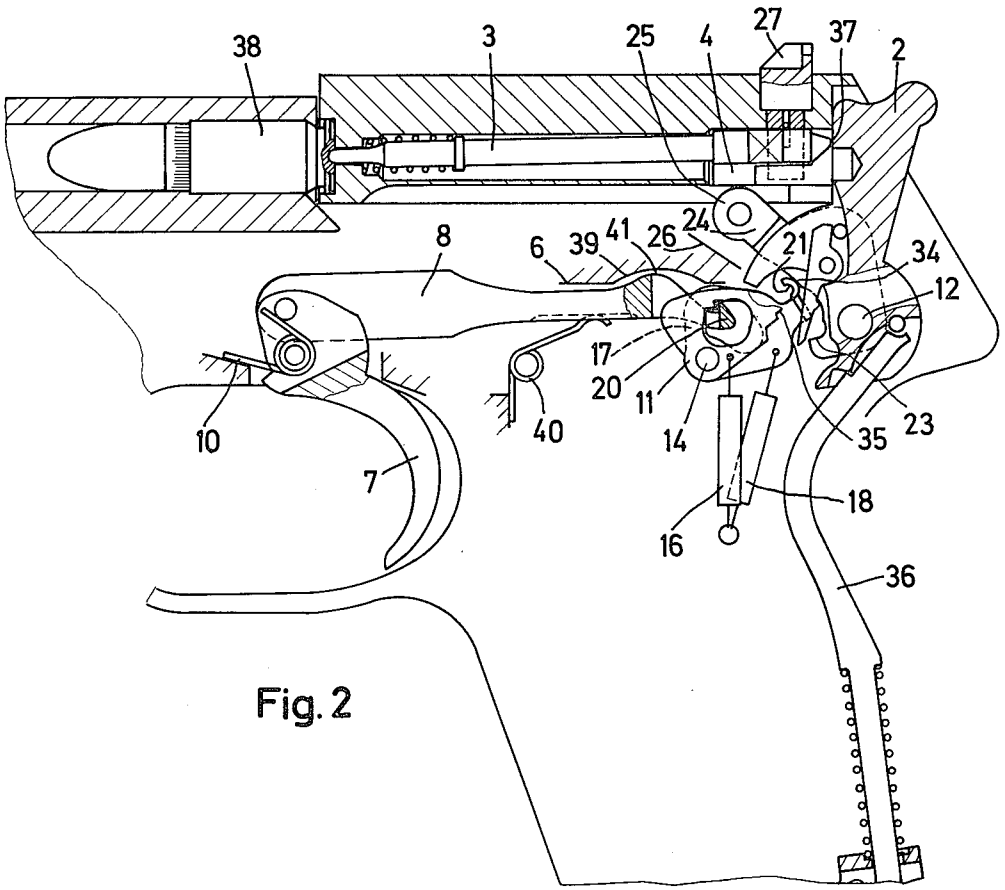
FIG. 2 is a view similar to that of FIG. 1 but showing the firing pin in its firing position.

As may be seen in FIG. 1, a hand firearm according to the present invention comprises a block 6 which is slidably mounted on the frame of the firearm having a handle 13. The block has positioned therein a firing pin 3 which is pivotable in a longitudinal plane about a pivot point as defined by the end of the firing pin which engages the cap of the cartridge as shown in the drawing. The firing pin 3 is shown in FIG. 1 in its lower or safety position and is pivotable to its upper or firing position as shown in FIG. 2. The lower portion of the firing pin is provided with a flange or projection 4 which extends downwardly to approximately a lower edge 5 of the block 6 when the firing pin is in its firing position. The end of the firing pin away from the cartridge chamber is provided with a tip portion 48.

Figure 5:
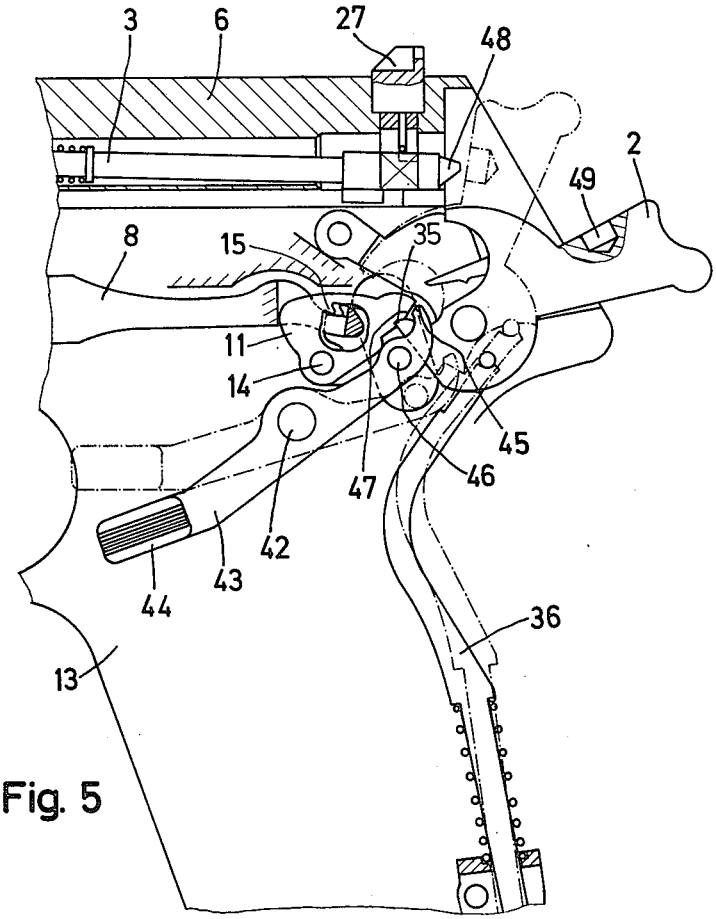
FIG. 5 is a view similar to that of FIGS. 1 and 3 and showing the firing pin in the safety position and the hammer in its cocked and uncocked positions.

A hammer 2 is pivotally mounted on a pin 12 in the handle 13 and is provided with a striking surface 37 which is engageable with the firing pin tip 48 when the firing pin is in the firing position as shown in FIG. 2. The striking face of the hammer 2 is provided with a recess 49 which receives the firing pin tip 48 when the firing pin is in its safety position and the hammer moves to the uncocked position as shown in FIG. 5.

A cocking lever 11 is pivotally mounted on a pin 14 firmly secured in the handle 13 and has a detent 15. A tension spring 16 is connected to the cocking lever 11 to urge the cocking lever downwardly as shown in the drawing. A second cocking lever 17 is pivotally mounted on the pin 14 beside the cocking lever 11 and is similarly pulled downwardly by a tension spring 18. The cocking lever 17 is provided with a detent 19 which is spaced rearwardly beyond the detent 15 of the cocking lever 11 by a suitable safety value when the hammer is in the cocked position and the value may be set in advance.

Figure 3:
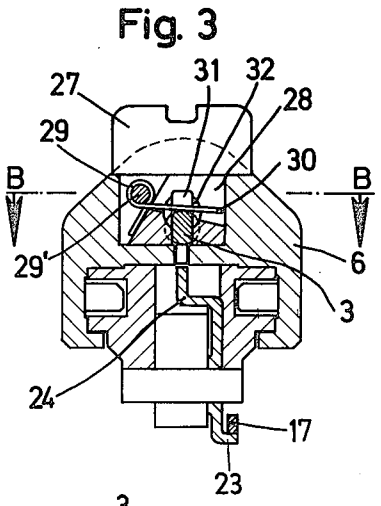
FIG. 3 is a sectional view taken along the line A—A of FIG. 1.
Figure 4:
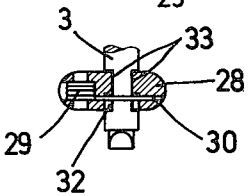
FIG. 4 is a sectional view taken along the line B—B of FIG. 3.

The cocking lever 17 provides a rectangularly bent flange 21 having a shoulder 22 which when pulled downwardly by spring 18 acts upon a shoulder 23 of a release lever 24 pivotally mounted on the pin 12. The release lever 24 is bent so that a portion thereof is positioned centrally below the firing pin as may be seen in FIG. 3 and comprises a rounded eye 25 position opposite from the firing pin and engaging a fixed abutment surface 26 in the handle 13 as seen in FIG. 1.

A trigger 7 is pivotally mounted on the frame of the firearm in a known manner and is pivotally connected to a trigger arm 8 provided with a shoulder 9 and at its end portion with a hook 20 engageable with the detents 15 and 19. A spring 10 maintains the trigger arm 8 in the position as shown in FIG. 1.

The block 6 is provided with a sight 27 underneath which there is slidably inserted an abutment member 28 positioned within the block and functioning to guide and limit the movement of the firing pin. A spring 29 is mounted on a pin 29' on the abutment member 28 and has one leg 30 which urges the firing pin 3 downwardly into its lower or safety position and maintains the firing pin in this safety position. The abutment member 28 is also provided with a groove 31 having a recess 32 formed in the portion 33 of the abutment number so as to slidably guide the firing pin 3 therein. The groove portions formed in the abutment portion 33 also limit the longitudinal movement of the firing pin 3. The firing pin is moveable upwardly within the groove 32 to its firing position.

Upon firing the firearm, the components will move into the positions as shown in FIG. 2. Pressure on the trigger 7 will move the trigger arm 8 to the left as viewed in FIG. 2 to cause the hook 20 to engage the detents 15 and 19 on the cocking levers 11 and 17 to pivot these cocking levers against the forces exerted by the springs 16 and 18. The shoulder 21 of cocking lever 17 will engage a cam surface 34 on the release lever 24 to raise the release lever into the position as shown in FIG. 2 wherein the rounded eye portion 25 engages the firing pin flange 4 to pivot the firing pin upwardly into its firing position. Simultaneous with this movement of the cocking lever 17, the cocking lever 11 is released from the hammer 2 at its catch or notch 35 and a spring loaded striking rod 36 acts against the hammer to drive the hammer upwardly and forwardly so that the striking surface 37 contacts the firing pin 3 to discharge the cartridge 38.

After firing, the block 6 will be automatically pushed rearwardly or to the right as viewed in FIG. 2 as a result of the recoil energy of the cartridge. This rearward movement of the block 6 will cause a recess 39 thereon to engage a cam projection 41 on the trigger arm 8 to lower the trigger arm 8 against the action of spring 40. The cocking lever 17 will be returned to its original position under the action of spring 18 and its shoulder 22 will engage shoulder 23 on the release lever 24. This engagement of the shoulder 23 will pivot the release lever 24 so that the rounded portion 25 is pivoted back against the abutment 26 into the position as shown in FIG. 1. The lowering of the rounded portion 25 will enable the spring 29 to push the firing pin 3 downwardly into its safety position as also shown in FIG. 1 in which position the firing pin will remain.

Since detent 19 on second cocking lever 17 is positioned rearwardly beyond detent 15 of the cocking lever 11 it will be seen that the detent 19 is positioned closer to the hammer 2 than detent 15. Thus, as the trigger arm 8 moves to the left its hook 20 will engage successively detents 19 and 15 to pivot these cocking levers against the forces exerted by their respective springs. The release lever 24 is pivoted into the position of FIG. 2 to raise the firing pin in the firing position only upon pivoting of cocking lever 17 under the action of trigger arm 8 acting upon detent 19. Thus, the release lever 24 will remain in its first position and the firing pin will remain in its safety position until the trigger is actually pulled. Thus, should the first cocking lever become disengageable from the hammer for any reason so that the hammer is released from its cocked position the release lever will remain in its first position and consequently the firing pin also will remain in its safety position.

As may be seen in FIG. 5, an uncocking lever 43 is pivotally mounted on a pin 42 secured within the firearm handle 13. The left end of the lever 43 is provided with a gripping surface 44 and its other end is provided with a projection 45 upon which there is mounted a pin 46. Pressure of the hand of the user of the firearm under the gripping surface 44 will pivot the lever 43 into its position as shown in the dot-dash line. This pivoting of the lever 43 will enable the pin 46 to apply pressure under a cocking lever surface 47 on the cocking lever 11. The cocking lever 11 will be lifted to disengage the hammer from the catch 35 of the cocking lever. The release of the hammer will enable the spring loaded rod 36 to pivot the hammer into the uncocked position as shown in the dot-dash line. The hammer is reliably prevented from contacting the firing pin 33 during any phase of this return movement since the firing pin is maintained in its lower or safety position and the firing pin tip 48 is received within the recess 49 in the hammer 2.

Thus it can be seen that the present invention has disclosed a safety device which is simple in construction and reliable in operation. The pivotally mounted firing pin is maintained in the safety position so that should the hammer be returned to its uncocked position the hammer striking surface will not engage the firing pin but a recess on the striking surface will receive the tip of the firing pin.

It will be understood that this invention is susceptible to modification in order to adapt it to different usages and conditions, and accordingly, it is desired to comprehend such modifications within this invention as may fall within the scope of appended claims.

What is claimed is:

1. A safety device for the firing pin of a hand firearm comprising a firing pin pivotable between a safety position and a firing position, a pivotally mounted hammer having a striking surface engageable with said firing pin when in its firing position and a recess receiving said firing pin when in its safety position, said hammer being pivotable between cocked and uncocked positions, a first pivotally mounted cocking lever having a portion thereof engageable with said hammer when in the cocked position to maintain said hammer in said cocked position, a pivotable release lever having a first position and a second position engageable with said firing pin to pivot said firing pin to the firing position, a second pivotally mounted cocking lever having a portion thereon engageable with said release lever, detent means on said second and first cocking levers successively positioned from said hammer in the cocked position of the hammer such that said first cocking lever being disengageable from said hammer to release the hammer from its cocked position without pivoting said release lever to its second position such that said firing pin remains in its safety position.

2. A safety device as claimed in claim 1 wherein said first and second cocking levers are pivotally mounted on a first pivot mount.

3. A safety device as claimed in claim 1 wherein said hammer and said release lever are pivotally mounted on a second pivot mount.

4. A safety device as claimed in claim 1 wherein detent means comprises a first detent on said first cocking lever and a second detent on said second cocking lever, said second detent being spaced rearwardly from said first detent in the cocked position of the hammer.

5. A safety device as claimed in claim 1 wherein said release lever has a rounded portion positioned below said firing pin, said firing pin having a flange thereon engageable by said release lever rounded portion.

6. A safety device as claimed in claim 5 wherein said firearm has a slidable block and said firing pin is in said block, the lowermost portion of said firing pin flange being at the lower edge of said block when the firing pin is in the safety position.

7. A safety device as claimed in claim 1 wherein said firearm has a slidable block and said firing pin is in said block, an abutment member in said block above said firing pin and having downwardly opening groove means therein slidably receiving and guiding said firing pin.

8. A safety device as claimed in claim 7 and a spring on said abutment member urging said firing pin into its safety position.

9. A safety device as claimed in claim 1 and an uncocking lever pivotally mounted on the handle of the firearm and having a pin thereon engageable with said first cocking lever to release said hammer from its cocked position whereby said hammer moves to its uncocked position.

* * * * *